US009219314B2

(12) United States Patent
Liu et al.

(10) Patent No.: US 9,219,314 B2
(45) Date of Patent: Dec. 22, 2015

(54) ARTIFICIAL ELECTROMAGNETIC MATERIAL

(75) Inventors: Ruopeng Liu, Shenzhen (CN); Lin Luan, Shenzhen (CN); Chaofeng Kou, Shenzhen (CN)

(73) Assignees: KUANG-CHI INNOVATIVE TECHNOLOGY LTD., Shenzhen (CN); KUANG-CHI INSTITUTE OF ADVANCED TECHNOLOGY, Shenzhen (CN)

( * ) Notice: Subject to any disclaimer, the term of this patent is extended or adjusted under 35 U.S.C. 154(b) by 440 days.

(21) Appl. No.: 13/583,881

(22) PCT Filed: Oct. 27, 2011

(86) PCT No.: PCT/CN2011/081408

§ 371 (c)(1),
(2), (4) Date: Sep. 10, 2012

(87) PCT Pub. No.: WO2013/000223

PCT Pub. Date: Jan. 3, 2013

(65) Prior Publication Data

US 2013/0154902 A1 Jun. 20, 2013

(30) Foreign Application Priority Data

Jun. 29, 2011 (CN) ..... 2011 1 0179776
Jun. 29, 2011 (CN) ..... 2011 1 0179837
Jun. 29, 2011 (CN) ..... 2011 1 0179888

(51) Int. Cl.
*H01Q 15/00* (2006.01)
*H01Q 15/02* (2006.01)

(52) U.S. Cl.
CPC ..... *H01Q 15/02* (2013.01); *H01Q 15/0026* (2013.01); *H01Q 15/0086* (2013.01)

(58) Field of Classification Search
CPC ..... H01Q 15/006; H01Q 15/0066; H01Q 15/0073; H01Q 15/008; H01Q 15/0086; H01Q 15/0093; H01Q 1/38
USPC ..... 343/700 MS, 846, 848, 909, 912
See application file for complete search history.

(56) References Cited

U.S. PATENT DOCUMENTS 7,826,504 B2 11/2010 Chen et al.
8,098,161 B2 * 1/2012 Lavedas ..... 340/572.7

(Continued)

FOREIGN PATENT DOCUMENTS

CN 1787280 A 6/2006
CN 102005637 A 4/2011
WO 2010021736 A 2/2010

OTHER PUBLICATIONS

"A microstrip phase shifter using complementary metamaterials" by Mingzhi Lu et al., <<Microwave and Millimeter Wave Technology 2008. ICMMT 2008. International Conference on, IEEE, Piscataway>> on Apr. 21, 2008; p. 2, figs. 2a and 2b, and abstract.

(Continued)

*Primary Examiner* — Robert Karacsony
*Assistant Examiner* — Patrick Holecek
(74) *Attorney, Agent, or Firm* — Leason Ellis LLP.

(57) ABSTRACT

An artificial electromagnetic material includes at least one material sheet. Each material sheet includes a substrate and a plurality of artificial microstructures attached to the substrate. Each substrate is virtually divided into multiple of substrate units arranged into an array. A pair of artificial microstructures is attached to each substrate. The pair of artificial microstructures includes a first artificial microstructure and a second artificial microstructure with different shapes. The dielectric constant of artificial electromagnetic materials gradually increases from zero in a certain frequency range, therefore the material has a low dielectric constant in the certain frequency range and can meet some needs of special situation.

19 Claims, 18 Drawing Sheets

(56) References Cited

U.S. PATENT DOCUMENTS

| | | | | |
|---|---|---|---|---|
| 8,120,546 | B2 * | 2/2012 | Smith et al. | 343/909 |
| 8,786,507 | B2 * | 7/2014 | Ayatollahi | 343/770 |
| 2006/0017651 | A1 | 1/2006 | Werner et al. | |
| 2008/0316140 | A1 | 12/2008 | Wu et al. | |
| 2010/0156573 | A1 * | 6/2010 | Smith et al. | 333/239 |
| 2010/0232017 | A1 * | 9/2010 | McCarthy et al. | 359/486 |
| 2010/0264524 | A1 | 10/2010 | Song et al. | |

OTHER PUBLICATIONS

"Metamaterials Theory, Design, and Applications" by Tie Jun Cui et al., on pp. 106 and 298, and figs. 6.5 and 13.1, published by <<Springer New York Dordrecht Heidelberg London>> on Dec. 31, 2010.

* cited by examiner

ARTIFICIAL ELECTROMAGNETIC MATERIAL

CROSS-REFERENCE TO RELATED PATENT APPLICATIONS

This is a U.S. National Phase Application under 35 U.S.C. §371 of International Patent Application No. PCT/CN2011/081408, filed Oct. 27, 2011, and claims the priority of Chinese Patent Application Nos. CN201110179888.6, CN201110179837.3 and CN201110179776.0, all filed on Jun. 29, 2011, all of which are incorporated by reference herein.

FIELD OF THE INVENTION

The present invention relates to material, and particularly to an artificial electromagnetic material.

BACKGROUND OF THE INVENTION

Artificial electromagnetic materials, normally known as metamaterials, are new artificial synthetic materials, are composed of at least a substrate made of non-metal materials and a number of artificial microstructures attached onto the surface of the substrate or embedded into the substrate. The substrate can be virtually divided into multiple substrate units arranged in an array. Artificial microstructures are attached to each substrate unit to form a metamaterial unit. Whole of the metamaterial is composed of many such metamaterial units, as crystal is composed of many lattices. The artificial microstructure in each of metamaterial unit can be the same or not identical. The artificial microstructure is composed of metal wires and is in a certain geometric pattern, which is plane structure or three-dimensional structure, such as a ring shape or an "I" shape.

Because of the existing of artificial microstructure, each of metamaterial units has electromagnetic characteristic which is different from the substrate. Therefore the metamaterial composed of all of the metamaterial units has special response characteristics to the electric field and magnetic field.

By designing different particular structures and shapes of the artificial microstructures, response characteristics of the whole metamaterial can be changed.

The dielectric constant of common materials changing with frequency usually has a resonant peak. As shown in FIG. 1, the dielectric constant when in low loss is usually greater than 10. In some applications, especially in large scale integrated circuits, materials with a low dielectric constant are necessary. Common materials are generally not satisfied.

DISCLOSURE OF THE INVENTION

Aiming at the defects of the prior art, a technical problem to be solved in present invention is to provide a material with a low dielectric constant. The dielectric constant of such material gradually increases from zero in a certain frequency range. Therefore in the certain frequency range it has a low dielectric constant.

The artificial electromagnetic material is provided in the invention, including at least one material sheet. Each material sheet includes a substrate and a plurality of artificial microstructures attached to the substrate. Each substrate is virtually divided into multiple of the substrate units arranged in an array. A pair of artificial microstructures is attached to each substrate unit, including a first artificial microstructure and a second artificial microstructure with different shapes.

Wherein, the first artificial microstructure includes an I-shaped structure and two split ring structures intersected with a middle connecting line of the I-shaped structure, two terminals of each split ring structure toward each other to form an opening, and two openings of the two split ring structure face each other.

The split ring structure of each first artificial microstructure includes a bending part with right angle or arc bending shape.

The second artificial microstructure includes four branches with a same intersection point. One end of each branch is connected to the intersection point and the other end is a free end. Each branch includes at least one bending part. When any one of the branches is rotated by 90 degrees, 180 degrees and 270 degrees in sequence about the intersection point as a rotation center, it will totally overlap the other three branches respectively.

The bending part of the second artificial microstructure is a right angle, a rounded angle or a sharp angle.

The free end of any one of the branches in the second artificial microstructure is connected with a wire segment.

The free end of any one of the branches in the second artificial microstructure is connected to the midpoint of the wire segment.

The second artificial microstructure includes two I-shaped structures which are orthogonal mutually. To each end of the two parallel sides of the I-shaped structure is connected a wire segment extending towards an inner side.

The wire segment is a straight line.

Two wire segments respectively connected with two adjacent ends of different I-shaped structures are parallel to each other.

The wire segment is an arc or a bending line.

The first artificial microstructure includes four branches with a same intersection point. One end of each branch is connected with the intersection point, and the other end is a free end. The branch includes at least one bending part. When any one of the branches is rotated by 90 degrees, 180 degrees and 270 degrees in sequence about the intersection point as a rotation center, it will totally overlap the other three branches respectively. The second artificial microstructure includes two I-shaped structures, which are orthogonal mutually. To each end of the two parallel sides of the I-shaped structure is connected a wire segment extending towards an inner side.

The bending part of the first artificial microstructure is a right angle, a rounded angle or a sharp angle.

The free end of any one of the branches in the first artificial microstructure is connected with a wire segment.

The free end of any one of the branches in the first artificial microstructure is connected to the midpoint of the wire segment.

The wire segment in the second artificial microstructure is a straight line.

Two wire segments connected with the two adjacent ends of the different I-shaped structures are parallel to each other.

The wire segment of the second artificial microstructure is an arc shape or a bending line.

The artificial microstructure is made from metal wires.

The artificial microstructure is made from copper or silver wires.

The artificial electromagnetic materials in the invention have the following advantageous effects: the dielectric constant of the materials gradually increases from zero in a certain frequency ranges. Therefore, in the certain frequency ranges it has a low dielectric constant, and can meet some specific applications.

BRIEF DESCRIPTION OF THE DRAWINGS

Other aspects, features, and advantages of this invention will become apparent from the following detailed description when taken in conjunction with the accompanying drawings, which are a part of this disclosure and which illustrate, by way of example, principles of this invention.

DETAILED DESCRIPTION OF ILLUSTRATED EMBODIMENTS

Figure 1:
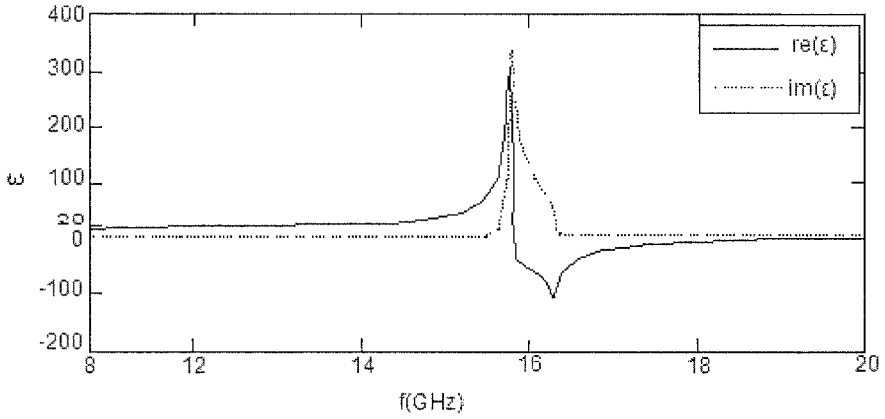
FIG. 1 is the dielectric constant characteristic curve of common materials.
Figure 2:
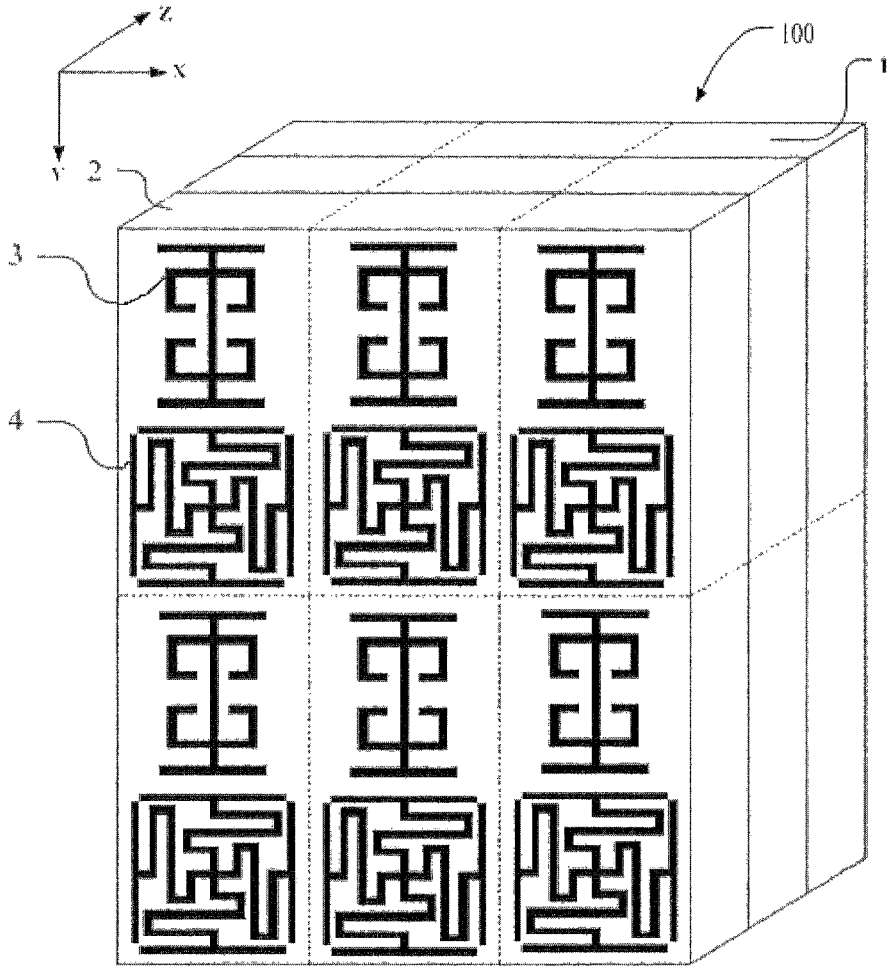
FIG. 2 illustrates the electromagnetic materials of a first embodiment of the invention.
Figure 3:
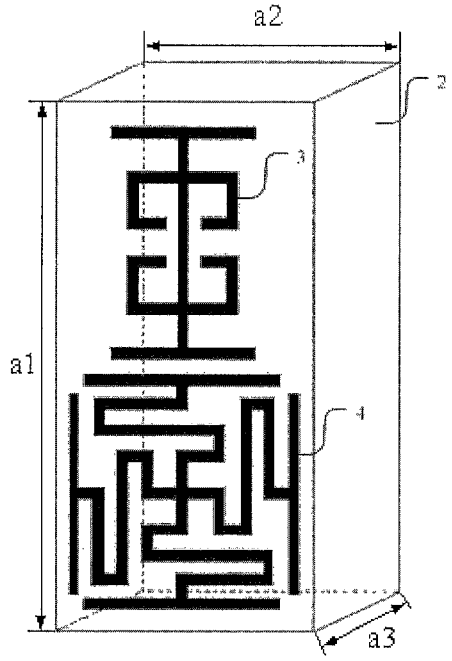
FIG. 3 illustrates a structure of a material unit of the artificial electromagnetic material.

Referring to FIGS. 2 to 3, an artificial electromagnetic material 100, with low dielectric constant is provided according to a first embodiment of the invention, including at least one material sheet 1. If there are several material sheets 1, the material sheets 1 are stacked in a direction perpendicular to its outer surface of each material sheet 1.

The artificial electromagnetic material 100 includes three material sheets 1. The material sheets 1 are parallel and spaced evenly. Multiple of material layers 1 are stacked in a direction perpendicular to a substrate (Z direction). Every two material sheets 1 can be mounted as a whole through a certain package process such as welding, riveting, bonding process and so on or through filling some materials capable of bonding the every two sheets together such as liquid substrate materials, which after being cured the every two material sheets 1 are bonded together, therefore multiple of material layers 1 can be formed as a whole.

Figure 4:
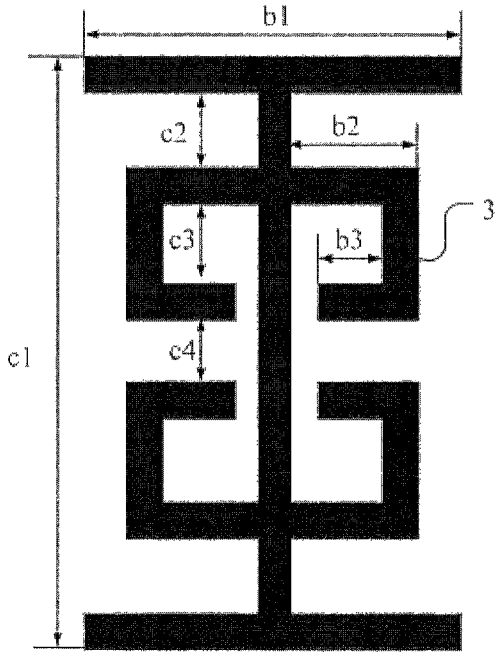
FIG. 4 illustrates a structure of a first artificial microstructure of the artificial electromagnetic materials in FIG. 2.
Figure 5:
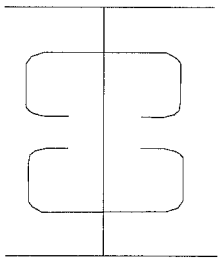
FIG. 5 illustrates another alternative structure of the first artificial microstructure in FIG. 4.
Figure 6:
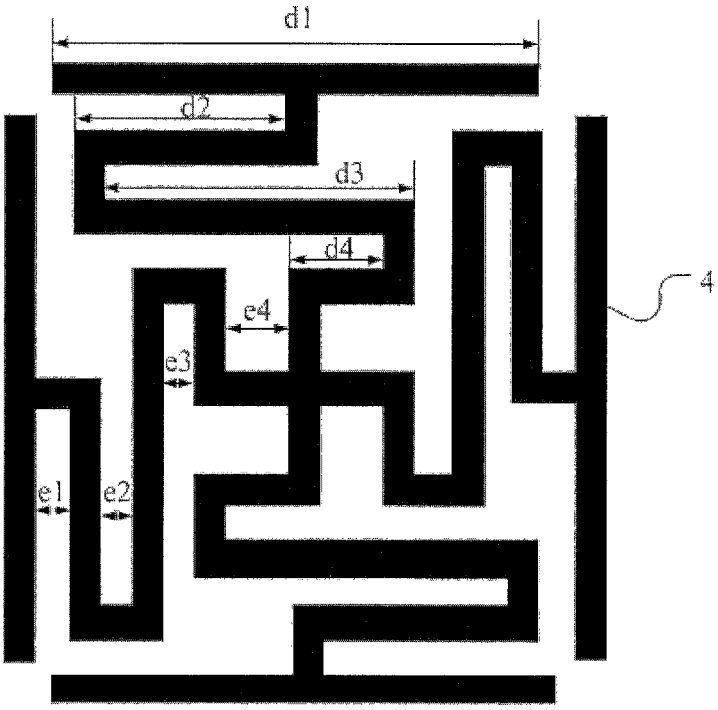
FIG. 6 illustrates the structure of a second artificial microstructure of the artificial electromagnetic materials in FIG. 2.
Figure 7:
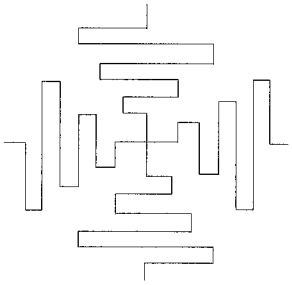
FIG. 7 to FIG. 11 are alternative structures of the second artificial microstructure.
Figure 8:
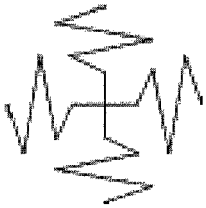
Figure 9:
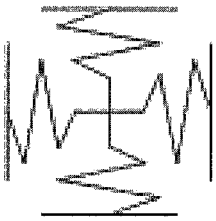
Figure 10:
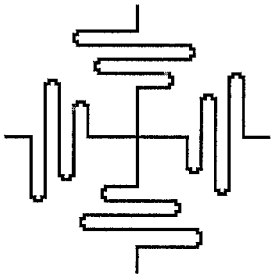
Figure 11:
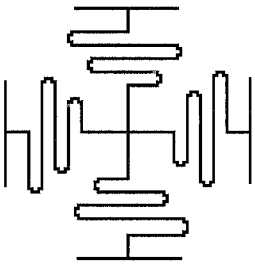
Figure 12:
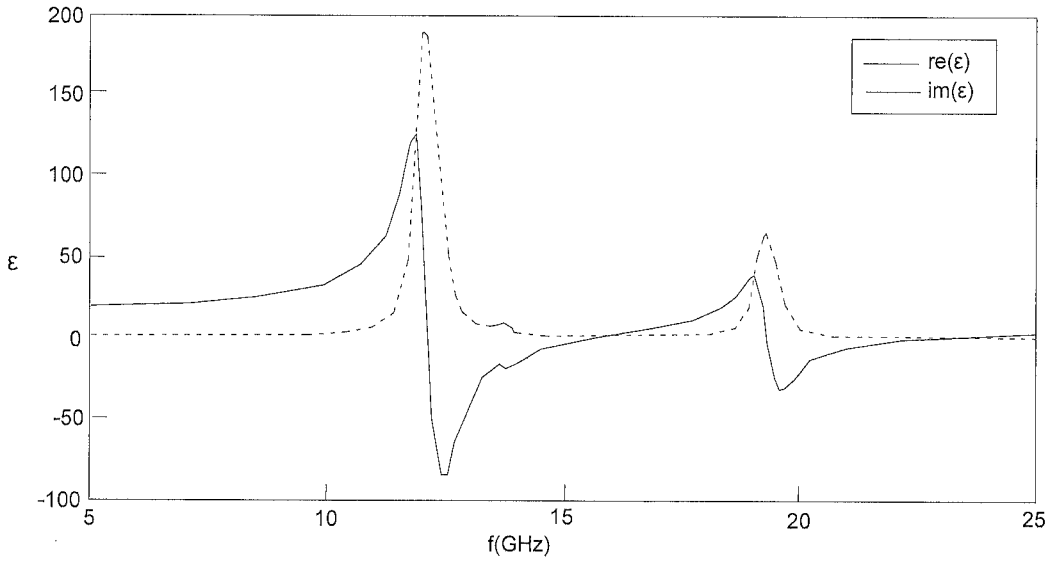
FIG. 12 illustrates the dielectric constant characteristic curve of the artificial electromagnetic materials in FIG. 2.

Each material sheet 1 includes a substrate and a plurality of artificial microstructures attached to the substrate. The substrate is virtually divided into multiple of rectangular columnar substrate units which are totally identical with and arranged neighbored to each other. Those substrate units are arranged in a rectangular array. In the rectangular arrays, X direction is defined as the direction of rows. Y direction perpendicular to the X direction is defined as the direction of columns. The size of the substrate unit is designed as 4 mm×2 mm×0.818 mm, wherein, mm represents millimeter. Referring to FIG. 3, as $a_1$=4 mm, $a_2$=2 mm, $a_3$=0.818 mm, a pair of artificial microstructures are respectively attached to an upper portion and a lower portion of each substrate unit. The pair of artificial microstructures includes a first artificial microstructure 3 and a second artificial microstructure 4. A material unit 2 is composed of the substrate unit and the pair of artificial microstructures attached to the substrate unit. The shape of the first artificial microstructure 3 is different from that of the second artificial microstructure 4. The artificial electromagnetic material 100 in the embodiment can be regarded as multiple of material units 2 arranged in three directions of the X, Y and Z directions. Wherein, the artificial microstructures can be attached to the substrate through etching, electroplating, diamond engraved, lithography, electron or ion etching method. The first artificial microstructure 3 and the second artificial microstructure 4 are made from metal wires. In the embodiment the metal wires are copper wires and the cross section of which is rectangular. The size of the cross section is 0.1 mm×0.018 mm. Wherein 0.1 mm is the width of the copper wire and 0.018 mm is its thickness. The metal wires also can be silver wires or other metal wires. The cross section of metal wires also can be cylindrical, flat or other shapes. The first artificial microstructure 3 of the embodiment as shown in FIG. 4 includes an I-shaped structure and two split ring structures intersected with a middle connecting line of the I-shaped structure. Two terminals of each split ring structure towards each other to form an opening, and two openings of the two split ring structures face each other. A bending part of each split ring structure in FIG. 4 is a right angle. The first artificial microstructure can also be like as shown in FIG. 5. The bending part of each split ring structure is an arc shape. The distance between the upper edge of the first artificial microstructure 3 and the boundary of the substrate unit to be attached is 0.1 mm. The first artificial microstructure 3 is horizontal centering arranged in the corresponding substrate unit. Referring to FIG. 4, the size of each part of the first artificial microstructure 3 is respectively: $b_1$=1.2 mm, $b_2$=0.4 mm, $b_3$=0.2 mm; $c_1$=1.8 mm, $c_2$=0.2 mm, $c_3$=0.3 mm, $c_4$=0.2 mm. The second artificial microstructure 4 as shown in FIG. 6, includes four branches with a same intersection point. One end of any one of the branches is connected to the intersection point and the other end is a free end. Each branch includes six bending parts. Each bending part is rectangular. When each of the branches is rotated by 90 degrees, 180 degrees and 270 degrees in sequence about the intersection point as a rotation center, it will totally overlap the other three branches respectively. The free end of each branch is connected a wire segment. The free end is connected to the midpoint of the wire segment. The size of each part in the second artificial microstructure 4 is respectively as: $d_1$=1.6 mm, $d_2$=0.7 mm, $d_4$=0.4 mm, $e_1$=$e_2$=$e_3$=0.1 mm, $e_4$=0.2 mm. The artificial microstructure can also be a variety of deformations, as shown in FIG. 7 to FIG. 11, the bending part can be a rounded angle or a sharp angle. The free end can be or can not be connected a wire segment. For simplicity, the structures in FIG. 5, FIG. 7 to FIG. 11 are drawn by fine lines. In fact, the structures all have a certain width, as shown in FIG. 2. The dielectric constant characteristic simulation figure corresponding to the electromagnetic wave passing through the materials is shown in FIG. 12. The solid line shown in FIG. 12 illustrates that the dielectric constant characteristic curve of the material has double resonances. For the second resonance, the dielectric constant gradually increases from zero in a certain frequency range such as 16 GHz~18 GHz. From the dotted line, it's known that the imaginary part of the dielectric constant in above frequency range where the dielectric constant is low is close to zero. Therefore the loss is low. The materials can be applied in the situation which requires a low dielectric constant.

When the low dielectric constant is required in other frequency ranges, it can be achieved by changing the dimensions of material unit or the first artificial microstructure 3 or the second artificial microstructure 4.

Figure 13:
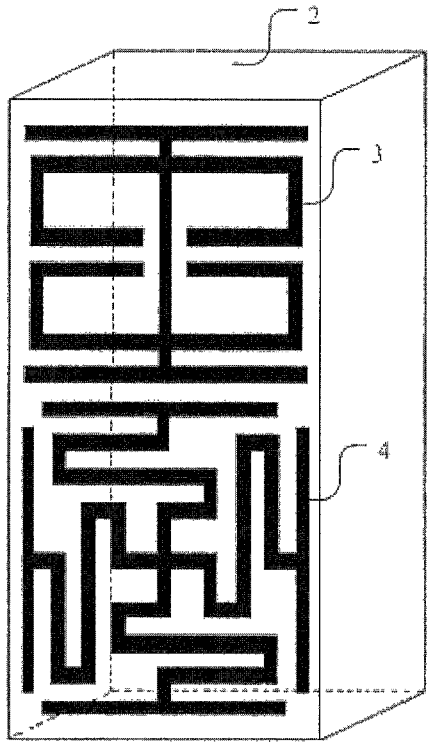
FIG. 13 illustrates a material unit of a second embodiment in the invention.
Figure 14:
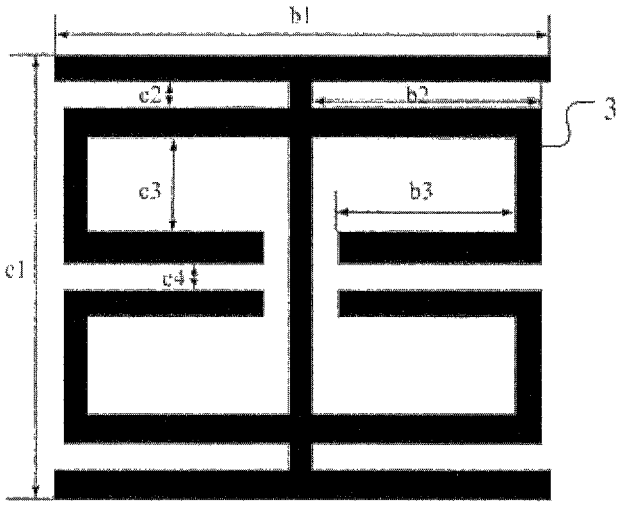
FIG. 14 illustrates the structure of a first artificial microstructure in the second embodiment.
Figure 15:
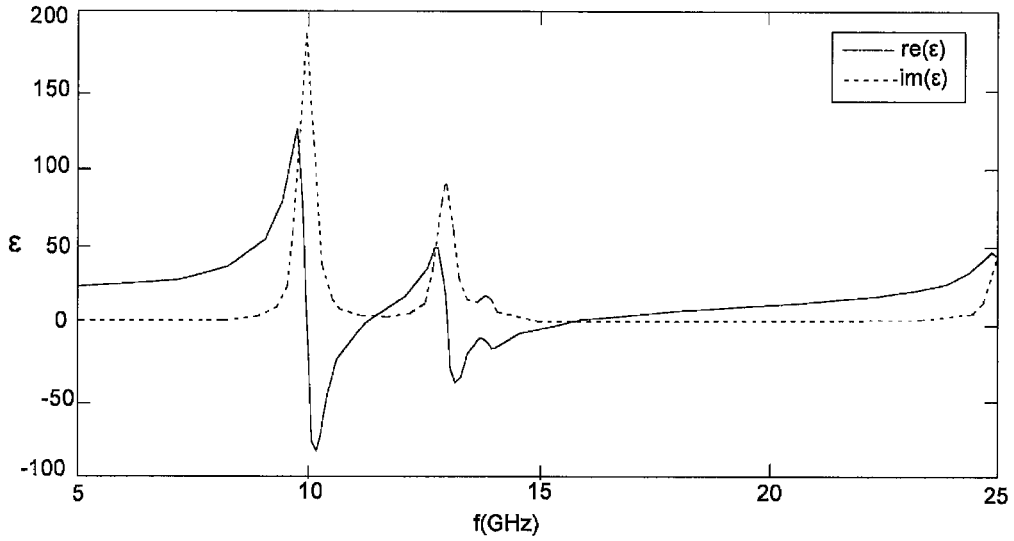
FIG. 15 illustrates dielectric constant characteristic curve of the artificial electromagnetic materials of the material unit in the second embodiment.

Referring to FIG. 13 and FIG. 14, the differences between the first and the second embodiment in the invention are: the dimensions of the first artificial microstructure 3 are different. The size of each part of the first artificial microstructure 3 of FIG. 14 is respectively: $b_1$=1.9 mm, $b_2$=0.85 mm, $b_3$=0.7 mm; $c_1$=1.8 mm, $c_2$=0.1 mm, $c_3$=0.45 mm, $c_4$=0.1 mm. The shape and the dimensions of the second artificial microstructure 4 are the same as the second artificial microstructure of first embodiment. The dielectric constant characteristic simulation figure corresponding to the electromagnetic wave passing through the materials is shown in FIG. 15. From the solid line as shown in FIG. 15, it can be found that the dielectric constant characteristic curve of the materials has multiple of resonance peaks. The dielectric constant gradually increases from zero in a certain frequency ranges such as 11.5 GHz~12.5 GHz and 15.5 GHz~24 GHz. From the dotted line, it's known that the imaginary part of the dielectric constant corresponding to the above frequency ranges with a low dielectric constant is close to zero, therefore the loss is low. The materials can also be used in the situation which requires the low dielectric constant. Comparing to the first embodiment, after changing the dimensions of the first artificial microstructure the frequency ranges that the dielectric constant increases gradually from zero is changed. Therefore when the low dielectric constant materials are required to be used in different frequency ranges, it can be achieved through changing the sizes of artificial microstructures.

Figure 16:
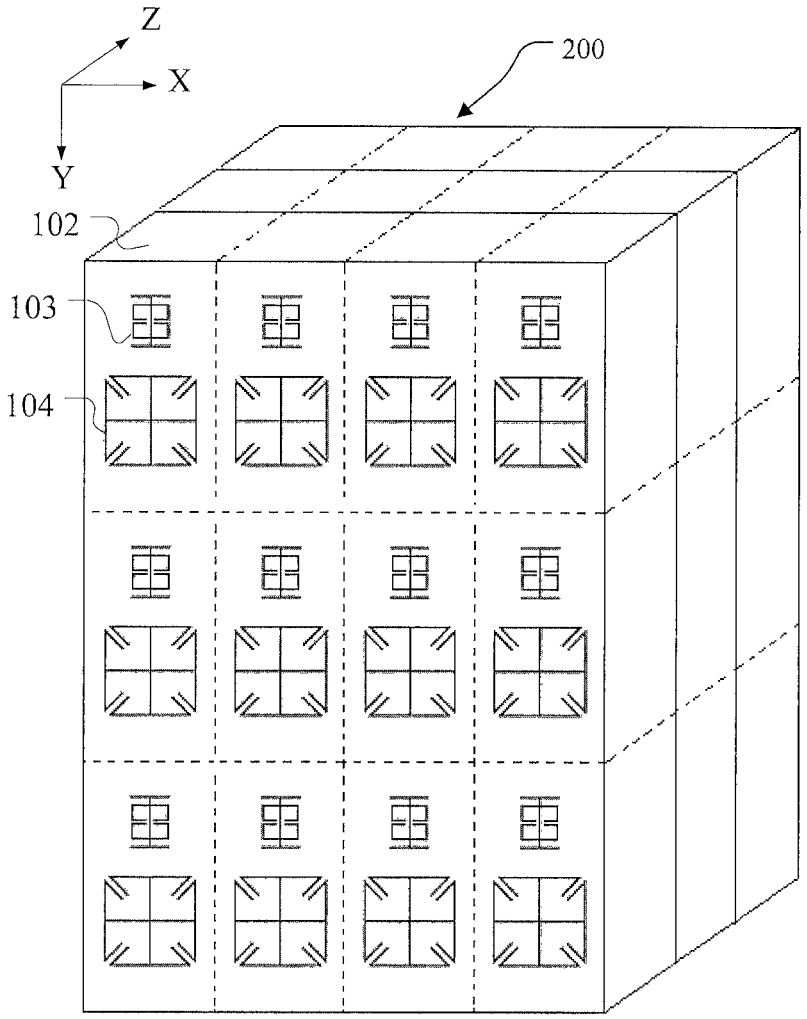
FIG. 16 illustrates the artificial electromagnetic materials of a third embodiment of the invention.
Figure 17:
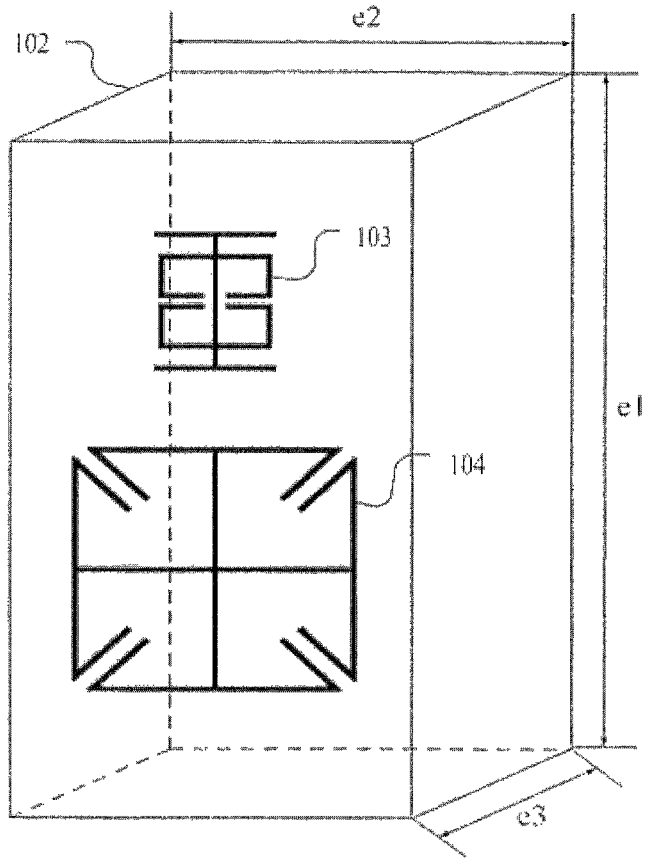
FIG. 17 illustrates the structure of a material unit of the artificial electromagnetic materials in FIG. 16.
Figure 18:
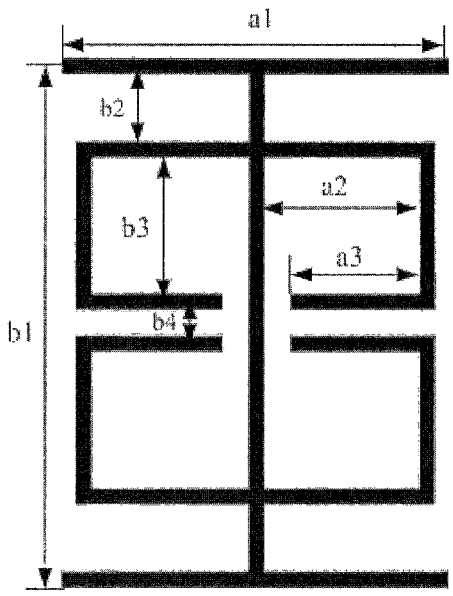
FIG. 18 illustrates the structure of a first artificial microstructure of the artificial electromagnetic materials in FIG. 16.
Figure 19:
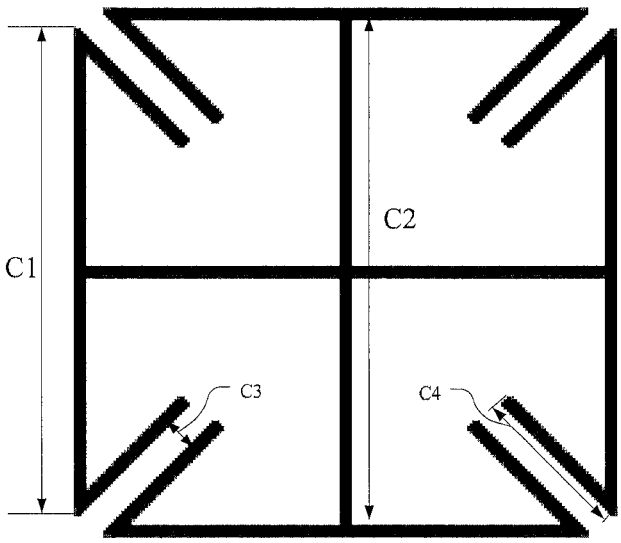
FIG. 19 illustrates the structure of a second artificial microstructure of the artificial electromagnetic materials in FIG. 16.
Figure 20:
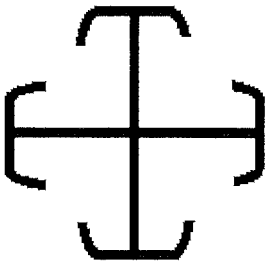
FIG. 20 to FIG. 21 illustrate alternative structures of the second artificial microstructure in FIG. 19.
Figure 21:
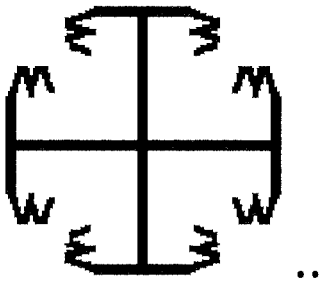
Figure 22:
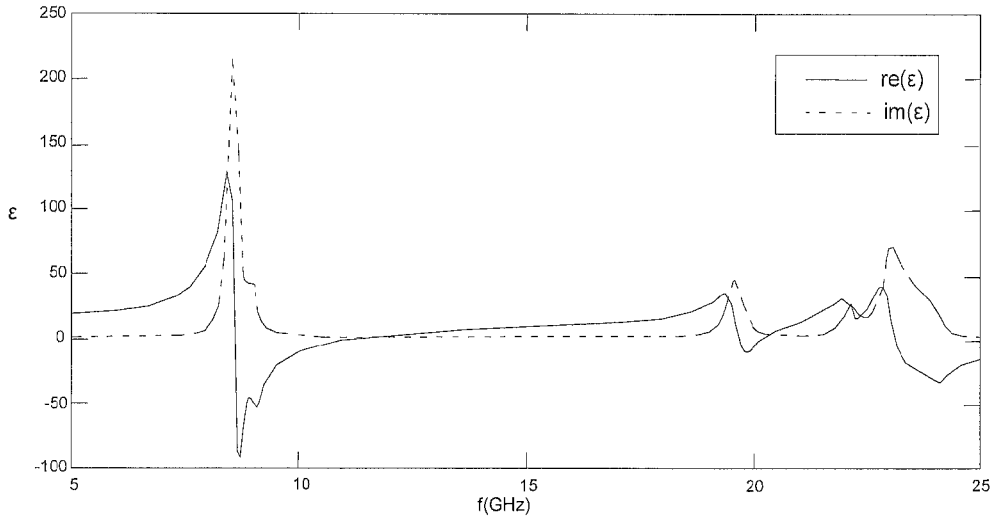
FIG. 22 illustrates the dielectric constant characteristic curve of the artificial electromagnetic materials in FIG. 16.

Referring to FIG. 16 and FIG. 17, in the invention the difference between the artificial electromagnetic materials 200 in the third embodiment and the artificial electromagnetic materials 100 in the first embodiment is: the dimension of the substrate unit 102 is designed to be 8 mm×4 mm×0.818 mm, referring to FIG. 17, where $e_1$=8 mm, $e_2$=4 mm, $e_3$=0.818 mm. The shape of the first artificial microstructure 103 of material unit 102 is the same with the shape of the first artificial microstructure in FIG. 2 of the first embodiment. The first artificial microstructure 103 can be as shown in FIG. 5, the bending part of the split ring structure is an arc shape. The distance between the upper edge of the first artificial microstructure 103 in FIG. 17 to the boundary of the substrate unit attached to the first artificial microstructure is 0.1 mm. The first artificial microstructure 103 is horizontal centering arranged in the corresponding substrate unit. Referring to FIG. 18, the dimensions of each part in the first artificial microstructure are respectively as: $a_1$=0.9 mm, $a_2$=0.4 mm, $a_3$=0.3 mm, $b_1$=1.9 mm, $b_2$=0.2 mm, $b_3$=0.4 mm, $b_4$=0.1 mm. The second artificial microstructure 104 is shown in FIG. 19, including two mutually orthogonal "I" shape structures. Each of the two ends of two mutually parallel sides in every "I" shape structure is connected with a wire segment. The wire segment extends towards to a space composed of the boundary line of the two "I" shape structures, namely extends to the inside. The dimensions of each part in the second artificial microstructure 104 are respectively as: $c_1$=$c_2$=2.89 mm, $c_3$=0.184 mm, $c_4$=0.75 mm. The artificial microstructure can also have multiple of deformations, as shown in FIG. 20 and FIG. 21, the bending part of which also can be an arc shape or a bending line. The dielectric constant characteristic simulation figure corresponding to the electromagnetic wave passing through the materials is shown in FIG. 22. From the solid line as shown in FIG. 22, it can be found that the dielectric constant characteristic curve of the materials has multiple of resonance peaks. The dielectric constant gradually increases from zero in a certain frequency range such as 11 GHz~18 GHz. From the dotted line, its known that the imaginary part of the dielectric constant corresponding in the above frequency range with a low dielectric constant is close to zero, so the loss is low. The materials can also be used in the situation which requires the low dielectric constant.

When the other frequency ranges that the low dielectric constant is required, it can also be achieved by changing the dimensions of the material unit or the dimensions of the first artificial microstructure or the dimensions of the second artificial microstructure.

Figure 23:
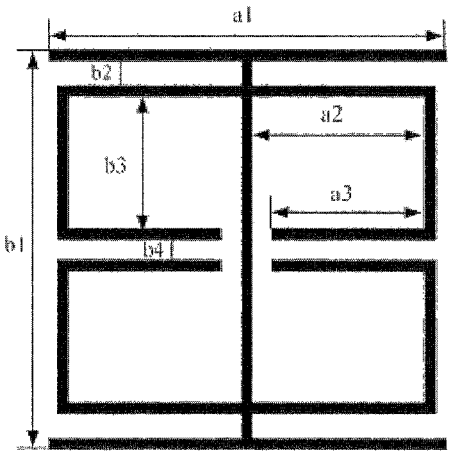
FIG. 23 illustrates a first artificial microstructure of the fourth embodiment in the invention.
Figure 24:
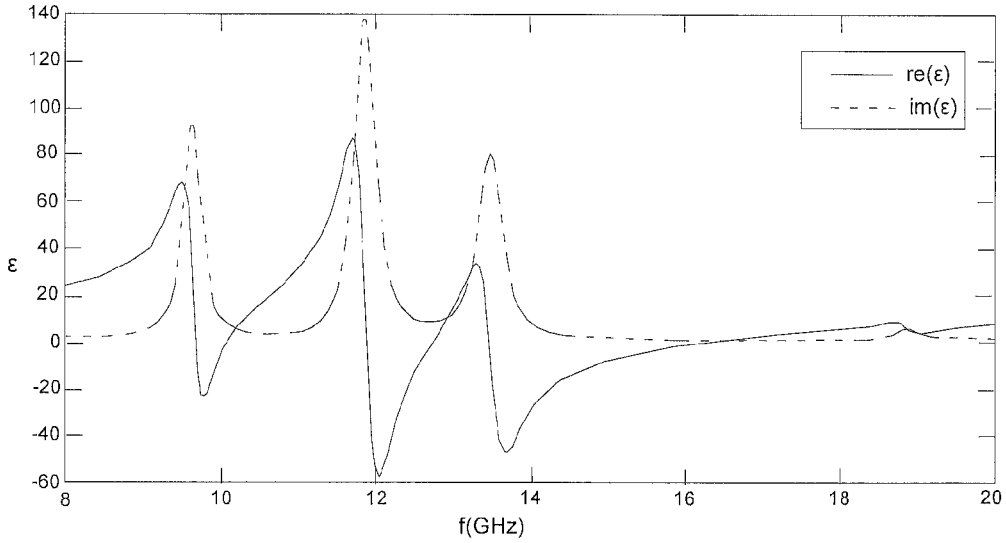
FIG. 24 illustrates the dielectric constant characteristic curve of the artificial electromagnetic materials of the material unit of the fourth embodiment.

Referring to FIG. 23, in the invention the differences between the fourth embodiment and the third embodiment are: the dimensions of the first artificial microstructure are different. The dimensions of each part in the first artificial microstructure of FIG. 23 are respectively as: $a_1$=1.8 mm, $a_2$=0.65 mm, $a_3$=0.55 mm, $b_1$=1.9 mm, $b_2$=0.1 mm, $b_3$=0.5 mm, $b_4$=0.1 mm. The shape and the dimensions of the second artificial microstructure is the same as the second artificial microstructure of the third embodiment. The dielectric constant characteristic simulation figure corresponding to the electromagnetic wave passing through the materials is shown in FIG. 24. From the solid line as shown in FIG. 24, it can be found that the dielectric constant characteristic curve of the materials has multiple of resonance peaks. The dielectric constant gradually increases from zero in a certain frequency range such as 10.1 GHz~11.3 GHz. From the dotted line, it's known that the imaginary part of the dielectric constant corresponding in the above frequency range with a low dielectric constant is close to zero, therefore the loss is low. The materials can also be applied in the situation which required the low dielectric constant. Comparing to the third embodiment, after changing the dimensions of the first artificial microstructure the frequency range that the dielectric constant gradually increases from zero is changed. Therefore when the low dielectric constant materials are applied in different frequency ranges, it can be achieved through changing the sizes of artificial microstructures.

Figure 25:
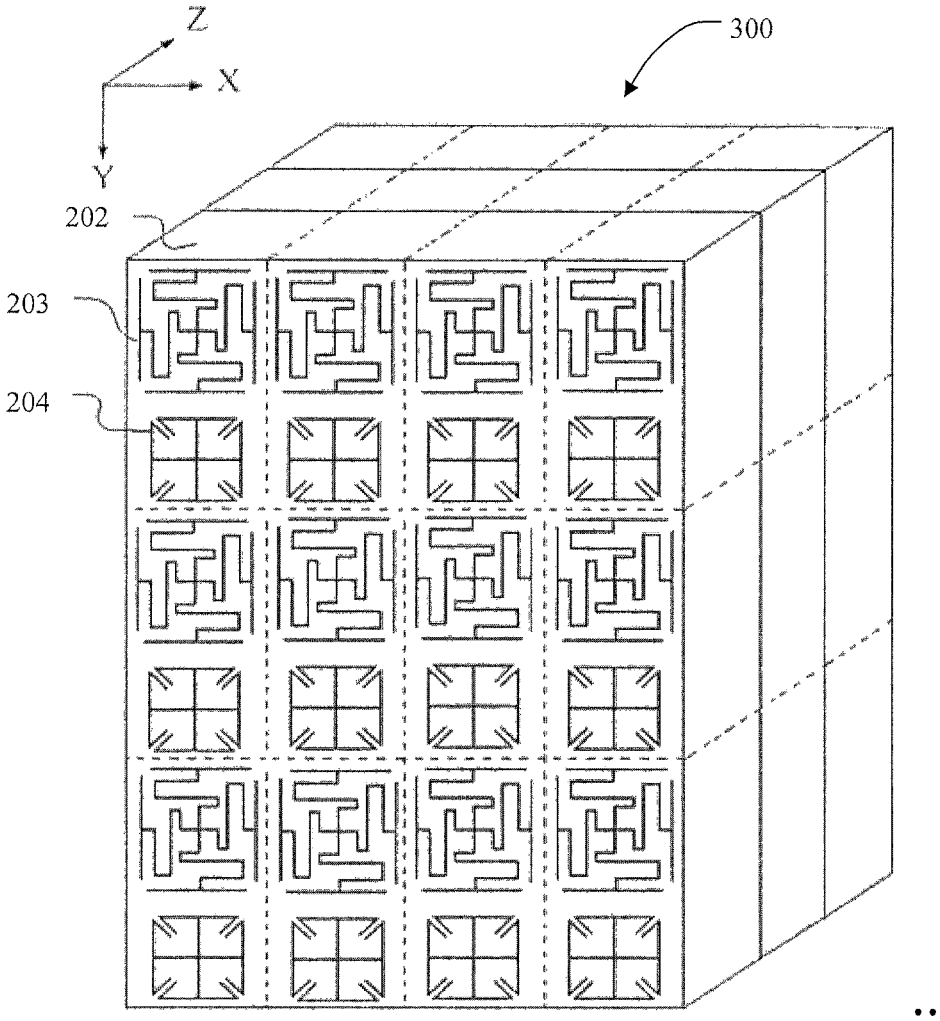
FIG. 25 illustrates the artificial electromagnetic materials of the fourth embodiment in the invention.
Figure 26:
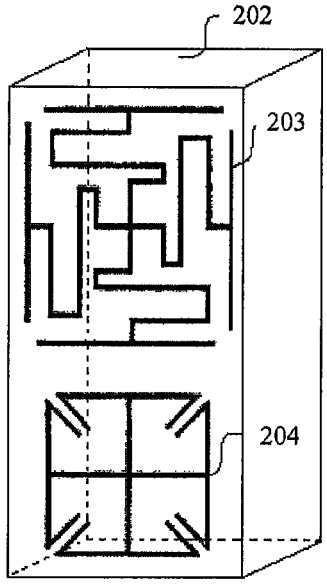
FIG. 26 illustrates the structure of a material unit of the artificial electromagnetic materials.
Figure 27:
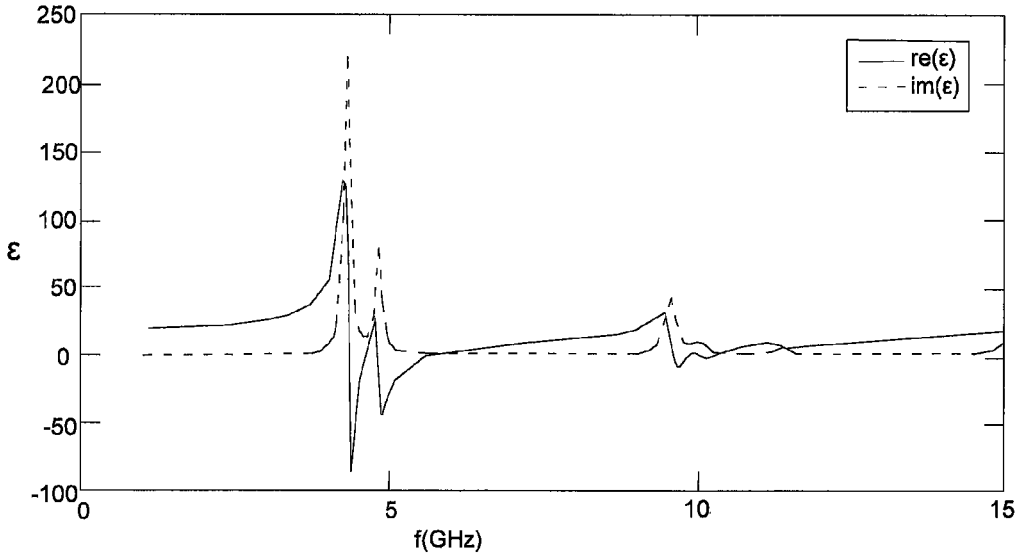
FIG. 27 illustrates a first figure of the dielectric constant characteristic curve of the artificial electromagnetic materials of the fourth embodiment of the invention.
Figure 28:
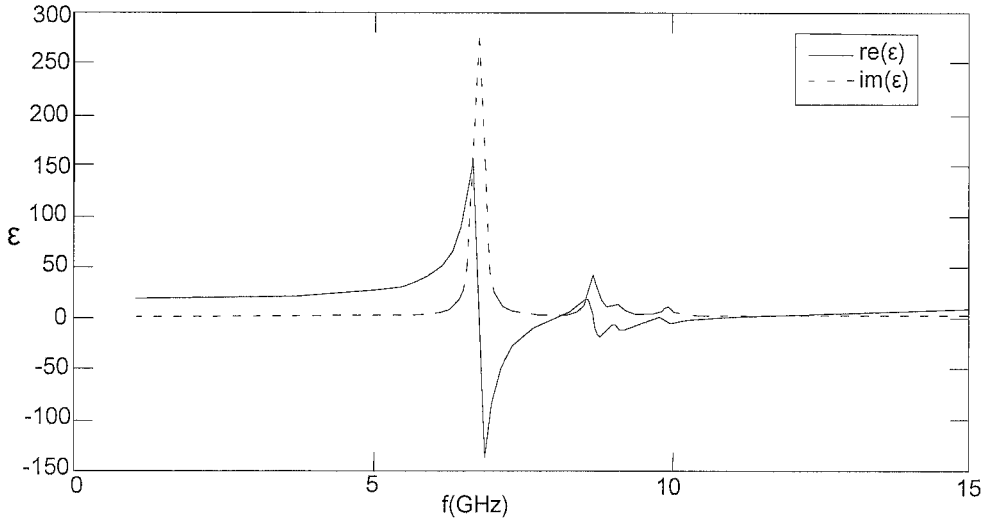
FIG. 28 illustrates a second figure of the dielectric constant characteristic curve of the artificial electromagnetic materials of the fourth embodiment of the invention.

Referring to FIG. 25 and FIG. 26, the differences between the artificial electromagnetic material 300 in the fifth embodiment and the artificial electromagnetic material 200 in the second embodiment 2 in the invention are: the first artificial microstructure 203 of the substrate unit 202 and the second artificial microstructure in the first embodiment is the same. The first artificial microstructure 203 includes four branches with a same intersection point. One end of each branch is connected to an intersection point and the other end is a free end. Each branch includes multiple of bending parts. The bending part is a right angle. When each branch is rotated by 90 degrees, 180 degrees and 270 degrees in sequence about the intersection point as a rotation center, it will totally overlap the other three branches respectively. The free end of each branch is connected a wire segment. The free end is connected to a midpoint of the wire segment. The artificial microstructure can also be a variety of deformations. As shown in FIG. 7 to FIG. 11, the bending part can be round or a sharp point. The free end can be or can not be connected with the wire segment. The second artificial microstructure 204 as shown in FIG. 26, includes two mutually orthogonal I-shaped structures. To each end of the two parallel sides of the I-shaped structure is connected a wire segment. The wire segment extends toward the space composed of the edge of the two I-shaped structures, namely extends towards the inner side. The artificial microstructure can also to be a variety of deformations, as shown in FIG. 20 and FIG. 21. The bending part can be an arc shape or bending line. FIG. 27 and FIG. 28 is the dielectric constant characteristic simulation figure corresponding to the electromagnetic wave passing through the materials. The size of artificial microstructure in FIG. 28 is smaller than the artificial microstructure in FIG. 27. From the solid line in FIG. 27, it can be found that the dielectric constant of the materials gradually increases from zero in a certain frequency range such as 11 GHz~18 GHz. From FIG. 28 the dielectric constant gradually increases from zero in a certain frequency range such as 8 GHz~8.5 GHz. From the dotted line in the figure, it known that the imaginary part of the dielectric constant corresponding in the above frequency range with a low dielectric constant is close to zero. Therefore the loss is low. The materials can be applied in the situation that required the low dielectric constant. When the low dielectric constant is required in other frequency ranges, it can be achieved through changing the dimensions of the material unit or the first artificial microstructure or the second artificial microstructure.

The disclosure described above is only a preferred embodiment in the present invention. Of course not to limit the scope of the right, so identical change made corroding to the present invention claim is still belongs to the scope of the invention.

What is claimed is:

1. An artificial electromagnetic material comprising: at least one material sheet, each material sheet comprising a substrate and a plurality of artificial microstructures attached to the substrate, each substrate being virtually divided into multiple of substrate units arranged in an array, a pair of artificial microstructures being attached to each substrate unit, the pair of artificial microstructures comprising a first artificial microstructure and a second artificial microstructure having different shapes, wherein the first artificial microstructure comprises an I-shape structure and two split ring structures, the I-shape structure comprises two parallel sides and an intermediate connecting line connected to the parallel sides, two terminals of each split ring structure face toward each other to form an opening, and two openings of the two split ring structures face each other, the two split ring structures are connected with the intermediate connecting line of the I-shape structure, and the intermediate connecting line crosses through the two split ring structure until the parallel sides; the second artificial microstructure comprising two mutually orthogonal I-shaped structures, each end of the two parallel sides of the I-shaped structure connected with a wire segment extending towards the space composed of the edge of the two I-shaped structures and the second artificial microstructure comprises four branches with a same intersection point, one end of any one of the branches connected to the intersection point and the other end is defined as a free end.

2. The artificial electromagnetic material of claim 1, wherein the split ring structure of the first artificial microstructure comprises a bending part, the bending part is right angle or an arch shape.

3. The artificial electromagnetic material of claim 2, wherein the branch comprises at least one bending part, when each branch is rotated by 90 degrees, 180 degrees and 270 degrees in sequence about the intersection point as a rotation center, it will totally overlap the other three branches respectively.

4. The artificial electromagnetic material of claim 3, wherein the bending part of the branch is rectangular, a rounded angle or a sharp angle.

5. The artificial electromagnetic material of claim 4, wherein the free end of each branch in the second microstructure is connected with a wire segment.

6. The artificial electromagnetic material of claim 5, wherein the free end of any one of the second artificial microstructures is connected to a midpoint of the wire segment.

7. The artificial electromagnetic material of claim 1, wherein the wire segment is a straight line.

8. The artificial electromagnetic material of claim 7, wherein the two wire segments respectively connected with adjacent end of the different I-shaped structures are parallel to each other.

9. The artificial electromagnetic material of claim 1, wherein the wire segment is an arc shape or a bending line.

10. The artificial electromagnetic material of claim 1, wherein the first artificial microstructure comprises four branches with a same intersection point, one end of any one of branches is connected with the intersection point and the other end is defined as a free end, each branch comprises at least one bending part, the second artificial microstructure includes two I-shaped structures which are orthogonal mutually, each end of the two parallel sides of the I-shaped structure is connected with a wire segment extending towards the space composed of the edge of the two I-shaped structures.

11. The artificial electromagnetic material of claim 10, wherein the bending part of the first artificial microstructure is a right angle, a rounded angle or a sharp angle.

12. The artificial electromagnetic material of claim 11, wherein the free end of any branches in the first artificial microstructure is connected with a wire segment.

13. The artificial electromagnetic material of claim 12, wherein the free end of any the first artificial microstructures is connected to a midpoint of the wire segment.

14. The artificial electromagnetic material of claim 10, wherein the wire segment in the second artificial microstructure is a straight line.

15. The artificial electromagnetic material of claim 14, wherein the two wire segments connected with two adjacent ends of different I-shaped structures are parallel to each other.

16. The artificial electromagnetic material of claim 11, wherein the wire segment in the second artificial microstructure is an arc shape or a bending line.

17. The artificial electromagnetic material of claim 1, wherein the artificial microstructure is made from metal wires.

18. The artificial electromagnetic material of claim 17, wherein the artificial microstructure is made from copper wire or silver wire.

19. An artificial electromagnetic material comprising:

at least one material sheet, each material sheet comprising a substrate and a plurality of artificial microstructures attached to the substrate, each substrate being virtually divided into multiple of substrate units arranged in an array, a pair of artificial microstructures being attached to each substrate unit, the pair of artificial microstructures comprising a first artificial microstructure and a second artificial microstructure having different shapes, wherein the first artificial microstructure comprises an I-shape structure and two split ring structures, the I-shape structure comprises two parallel sides and an intermediate connecting line connected to the parallel sides, two terminals of each split ring structure face toward each other to form an opening, and two openings of the two split ring structures face each other, the two split ring structures are connected with the intermediate connecting line of the I-shape structure, and the intermediate connecting line crosses through the two split ring structure until the parallel sides, and the split ring structures are separated from the two parallel sides by at least 0.1 mm; and the second artificial microstructure comprises four branches with a same intersection point, one end of any one of the branches connected to the intersection point and the other end is defined as a free end.

* * * * *